US005716121A

United States Patent [19]

Dubois

[11] Patent Number: 5,716,121

[45] Date of Patent: Feb. 10, 1998

[54] CONVERTIBLE FLEXIBLE AND RIGID FLASHLIGHT

[75] Inventor: Craig A. Dubois, Trumbull, Conn.

[73] Assignee: Black & Decker Inc., Newark, N.J.

[21] Appl. No.: 740,828

[22] Filed: Nov. 4, 1996

[51] Int. Cl.[6] ..... F21L 11/00

[52] U.S. Cl. ..... 362/198; 362/202; 362/208

[58] Field of Search ..... 362/197, 198, 362/199, 202, 208, 191, 275, 287, 288, 388, 418, 427

[56] References Cited

U.S. PATENT DOCUMENTS

| | | | |
|---|---|---|---|
| D. 360,480 | 7/1995 | Hon | D26/43 |
| 1,692,394 | 11/1928 | Sundh . | |
| 2,550,423 | 4/1951 | Nelson . | |
| 2,581,129 | 1/1952 | Muldoon . | |
| 3,681,590 | 8/1972 | Dickie | 240/10.5 |
| 4,347,553 | 8/1982 | Saron | 362/189 |
| 4,495,550 | 1/1985 | Visciano | 362/189 |
| 4,912,612 | 3/1990 | Giorgi | 362/285 |
| 5,176,438 | 1/1993 | Fisherman | 362/99 |
| 5,280,416 | 1/1994 | Hartley | 362/98 |
| 5,287,255 | 2/1994 | Strodtman | 362/102 |
| 5,412,548 | 5/1995 | Yee | 362/202 |
| 5,442,528 | 8/1995 | Vandenbelt | 362/98 |
| 5,465,196 | 11/1995 | Hasenberg et al. | 362/183 |
| 5,517,392 | 5/1996 | Rousso et al. | 362/198 |
| 5,521,803 | 7/1996 | Eckert et al. . | |
| 5,567,115 | 10/1996 | Carbone . | |

*Primary Examiner*—Y. My Quach
*Attorney, Agent, or Firm*—Barry E. Deutsch

[57] ABSTRACT

A flashlight with a power supply end, an illumination end, a flexible neck and a slideable rigid sleeve. The sleeve is movable between a retracted position and an extended position. The retracted position comprises the sleeve being located on the power supply end away from the flexible neck such that the neck can be flexed to reposition the illumination end relative to the power supply end. The extended position comprises the sleeve extending over the flexible neck between the power supply end and the illumination end to prevent the neck from bending. This prevents the illumination end from being repositioned relative to the power supply end.

18 Claims, 1 Drawing Sheet

CONVERTIBLE FLEXIBLE AND RIGID FLASHLIGHT

BACKGROUND OF THE INVENTION

1. Field of the Invention

The present invention relates to flashlights and, more particularly, to a flashlight with a flexible section that can be converted into a rigid configuration flashlight.

2. Prior Art

U.S. Pat. Nos. 1,692,394; 2,550,423; 2,581,129; 5,176,438; 5,442,528 and 5,280,416 disclose lights with extendable flexible sections. U.S. Pat. No. 5,412,548 discloses a flashlight with an axially extendable sleeve. U.S. Pat. No. Des. 360,480 discloses a flashlight with a flex arm and a receiving channel for the flex arm.

SUMMARY OF THE INVENTION

In accordance with one embodiment of the present invention a flashlight is provided comprising an illumination end, an opposite power supply end, a flexible neck, and a rigid sleeve. The flexible neck connects the illumination end to the power supply end. The rigid sleeve is slidingly connected to the power supply end between a retracted position and an extended position. The extended position has the sleeve extend between the illumination end and the power supply end to enclose the neck and prevent the illumination end from substantially moving relative to the power supply end.

In accordance with another embodiment of the present invention a flashlight is provided having a rigid tail and a repositionable illumination section. The repositionable illumination section has an illumination head and a flexible neck. The flexible neck connects the illumination head to the rigid tail. The improvement comprises means for converting the repositionable illumination section into a rigid section. The means for converting comprises a rigid sleeve slidable from the tail onto the flexible neck to prevent the neck from flexing.

In accordance with one method of the present invention a method of converting a flashlight having a repositionable illumination head into a substantially rigid configuration is provided comprising steps of providing the flashlight with a longitudinally slidable rigid sleeve; and sliding the sleeve from a retracted position on a tail of the flashlight to an extended position along a flexible neck of the flashlight to thereby prevent the neck from flexing and prevent repositioning of the illumination head relative to the tail.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
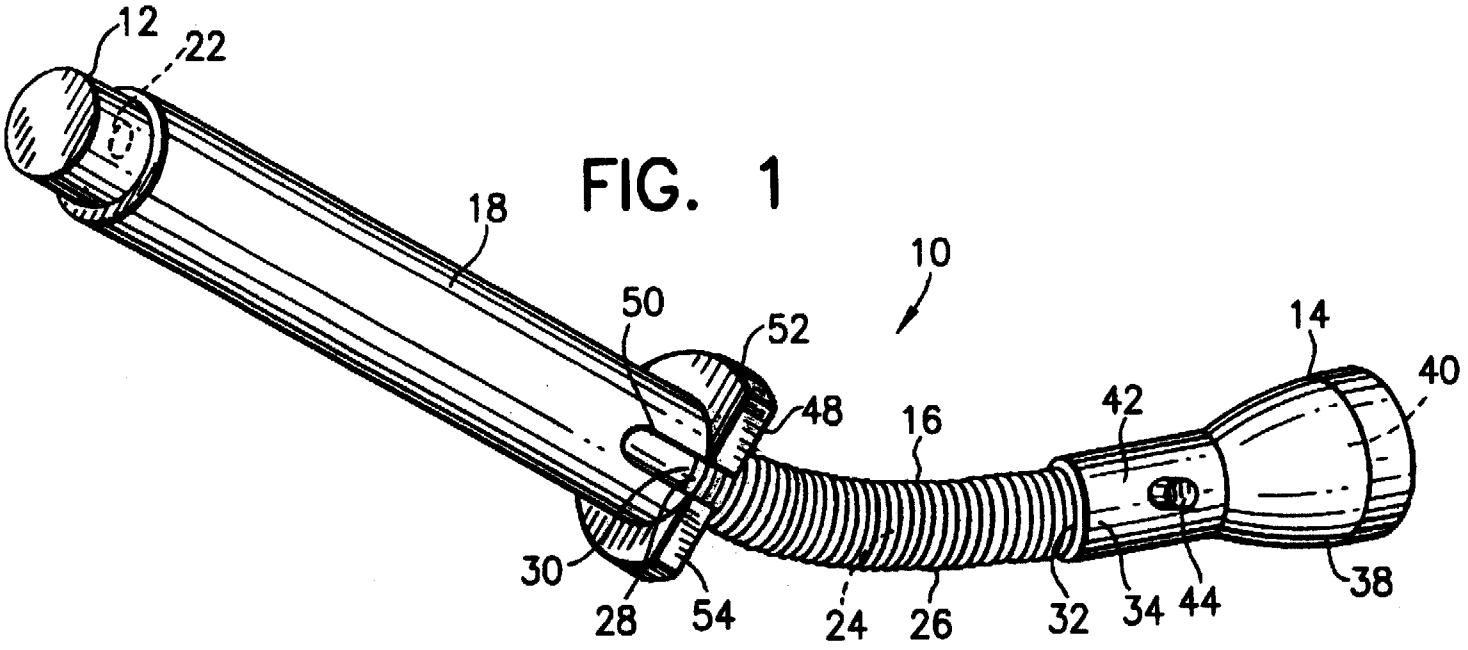
FIG. 1 is a perspective view of a flashlight incorporating features of the present invention.

Referring to FIG. 1, there is shown a perspective view of a flashlight 10 incorporating features of the present invention. Although the present invention will be described with reference to the single embodiment shown in the drawings, it should be understood that features of the present invention could be embodied in many different forms of alternate embodiments and in different types of flashlights. In addition, any suitable size, shape or type of elements or materials could be used.

Figure 2:
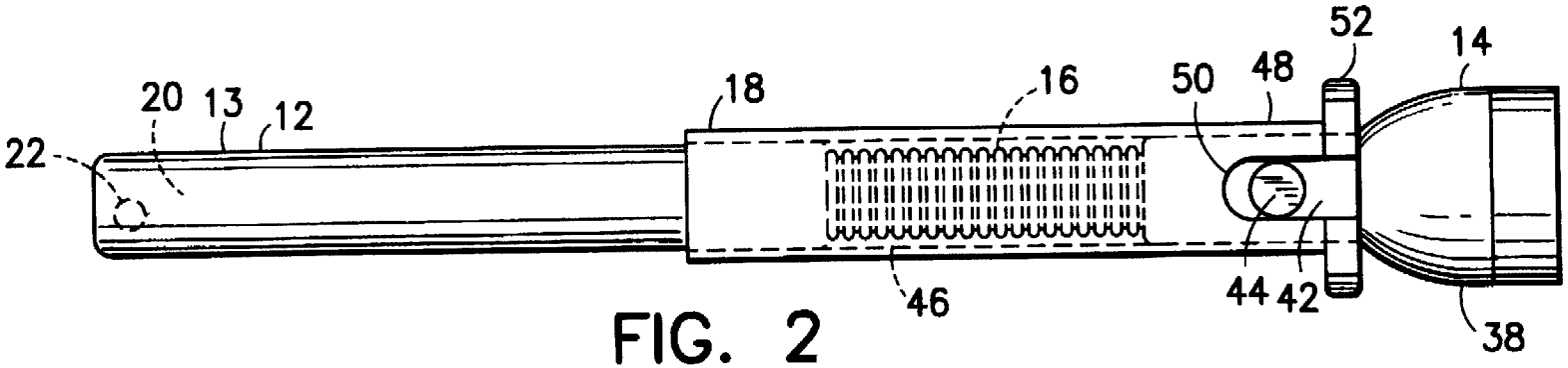
FIG. 2 is an elevation side view of the flashlight shown in FIG. 1 with the sleeve at an extended position.

Referring also to FIG. 2, the flashlight 10 includes a tail 12, an illumination head 14, a flexible core or neck 16, and a sleeve 18. The tail 12 is generally rigid. The tail 12 preferably has a battery receiving area 20 therein. Thus, the tail 12 forms a power supply end for the flashlight. Alternatively, or additionally, the tail 12 could have an electrical connector 22 to allow the flashlight to be powered by an alternative power supply, such as an adapter. In the embodiment shown, the housing 13 of the tail 12 has a general circular column shape. However, in alternate embodiments, any suitably shaped tail or base could be provided.

The flexible neck 16 has a rear end 28 which is connected to a front end 30 of the tail 12. The flexible neck 16, in the embodiment shown, comprises an inner flexible spine 24 and an outer resilient sleeve 26. The spine 24 is comprised of a plurality of interconnected universally rotatable members. The neck 16 is substantially the same as the flexible core described in U.S. Pat. Nos. 5,517,392; 5,521,803 and 5,567,115 which are hereby incorporated by reference in its entirety. In alternate embodiments, other types of flexible necks or cores could be used. The front end 32 of the neck 16 is connected to a rear end 34 of the illumination head 14.

The illumination head 14 includes a housing 38 and a light bulb 40 located inside the housing 38. The housing 38 includes a rear section 42 and a protrusion 44. The protrusion 44 extends from the rear end section 42. The protrusion 44 could be part of the rear end section 42 or, alternatively, could be an ON/OFF switch for the flashlight. The rear end section 42, except for the protrusion 44, has the same exterior profile and size as the tail 12. In alternate embodiments, other shapes and sizes of the housings and sleeve could be provided so long as the shape of the sleeve 18 is configured to slidably move and mate with the two housings. In addition, any suitable type of illumination head housing could be used. In addition, any suitable type of light bulb or light source could be used. The spine 24 of the neck 16 structurally connects the housing 38 to the housing 13 of the tail 12. Electrical conductors (not shown) extend from the tail 12, through the neck 16, and to the light bulb 40 for supplying electrical power to the light bulb. Any suitable type of electrical power supply control could also be provided.

The sleeve 18 is preferably a one-piece member with a general tube shape. The sleeve 18 is longitudinally slidingly mounted on the tail 12. FIG. 1 shows the sleeve 18 in a retracted position. FIG. 2 shows the sleeve 18 in an extended position. The inner channel 46 of the sleeve 18 has a cross-sectional size and shape substantially the same as the outer profiles of the tail housing 13 and the head rear section 42. As illustrated by FIG. 2, the flexible neck 16, when straight, can fit inside the channel 46. The front 48 of the sleeve 18 includes a slot 50 and an extended rim 52. The front 48 could also include a funnel shape at the channel 46 to guide the sleeve 18 onto the neck 16. The length of the sleeve 18 is longer than the length of the neck 16. This allows the sleeve 18 to extend directly between the head 14 and the tail 12. In an alternate embodiment, the sleeve could be located inside the housing 13 of the tail 12 and be extendable along the inside of the neck 16 into or onto the housing of the illumination head. In another alternate embodiment, the sleeve need not have a tubular shape. It could include rods or cross-sectional arced sections. Any suitable shape to provide a structural bridge between the two housings 13, 38 could be provided.

In the configuration shown in FIG. 1, with the sleeve 18 in its retracted position, the neck 16 and head 14 form a repositionable illumination section for the flashlight 10. The head 14 can be repositioned and held at any suitable position relative to the tail 12 by merely bending the articulating neck 16. However, a user can reconfigure the flashlight 10 into a substantially rigid configuration as shown in FIG. 2. This reconfiguration merely comprises extension of the sleeve 18 from its retracted position shown in FIG. 1 to its extended position shown in FIG. 2. The user may straighten the neck 16 before extension or the sleeve 18 will straighten the neck 16 during extension. In the extended position, the sleeve 18 receives the rear section 42 of the illumination head housing 38 in the channel 46. The protrusion 44 is also received in the slot 50 to interlock the sleeve 18 to the housing 38. The slot 50 could be tapered to form a frictional gripping of the sleeve 18 to the housing 38. Alternatively, any suitable means could be used to retain the sleeve 18 in its extended position until a user decides to move it back to its retracted position. With the sleeve 18 extended, it forms a structurally rigid bridge between the two housings 13, 38. This prevents the neck 16 from flexing and prevents the illumination head 14 from substantially moving or being repositioned relative to the tail 12. Thus, a substantially rigid flashlight configuration is provided. The flashlight 10 can be reconfigured back to its configuration shown in FIG. 1 merely by longitudinally sliding the sleeve 18 rearward. It should be noted that the length of the neck 16 remains the same in all configurations. However, the neck 16 must be substantially straight when the sleeve 18 is extended. Suitable means may also be provided on the tail 12 to retain the sleeve 18 at its retracted position until moved by a user.

In the embodiment shown, the rim 52 of the sleeve 18 has a flat area 54. The flat area 54 is provided to form a means for preventing the flashlight 10 from rolling on the ground. Thus, with the sleeve 18 retracted, a user can place the sleeve 18 on the ground with the flat area 54 against the ground. The head 14 can be repositioned to any suitable angle without substantial risk that the flashlight will roll along the ground. In alternate embodiments, alternative or additional means to prevent rolling or otherwise stably support the flashlight could be provided. Preferably, means are provided to prevent the sleeve 18 from axially rotating relative to the tail 12. However, frictional interference between the housing 13 and the sleeve 12 may be sufficient to prevent axial rotation.

It should be understood that the foregoing description is only illustrative of the invention. Various alternatives and modifications can be devised by those skilled in the art without departing from the scope of the invention. Accordingly, the present invention is intended to embrace all such alternatives, modifications and variances which fall within the scope of the appended claims.

What is claimed is:

1. A flashlight comprising:

an illumination end;

an opposite power supply end;

a flexible neck connecting the illumination end to the power supply end; and a rigid sleeve slidingly connected to the power supply end between a retracted position and an extended position, the extended position having the sleeve extend between the illumination end and the power supply end to enclose substantially the entirety of the neck and prevent the illumination end from substantially moving relative to the power supply end.

2. A flashlight as in claim 1 wherein the retracted position has the sleeve positioned substantially entirely on the power supply end away from the neck such that the neck can flex for repositioning of the illumination end relative to the power supply end.

3. A flashlight as in claim 1 further comprising means for interlocking a front of the sleeve to the illumination end.

4. A flashlight as in claim 3 wherein the means for interlocking includes a projection on a housing of the illumination end and a receiving slot on the front of the sleeve.

5. A flashlight as in claim 1 wherein the sleeve is substantially tubular.

6. A flashlight as in claim 5 wherein the sleeve includes means for preventing the flashlight from rolling.

7. A flashlight as in claim 1 wherein the power supply end is substantially tubular with a battery receiving area therein.

8. A flashlight as in claim 1 wherein a length of the neck between the illumination end and the power supply end remains the same in both the extended and retracted positions of the sleeve.

9. In a flashlight having a rigid tail and a repositionable illumination head and a flexible neck, the flexible neck connecting the illumination head to the rigid tail, wherein the improvement comprises:

means for converting the repositionable illumination section into a rigid section, the means for converting comprising a rigid sleeve sliding from the tail onto substantially the entirety of the flexible neck to prevent the neck from flexing, the sleeve having an extended position connecting a housing of the rigid tail with a housing of the illumination head.

10. A flashlight as in claim 9 wherein the sleeve has a retracted position positioned substantially entirely on the tail and away from the neck such that the neck can flex for repositioning of the illumination head relative to the tail.

11. A flashlight as in claim 9 further comprising means for interlocking a front of the sleeve to the illumination head.

12. A flashlight as in claim 11 wherein the means for interlocking includes a projection on a housing of the illumination head and a receiving slot on the front of the sleeve.

13. A flashlight as in claim 9 wherein the sleeve is substantially tubular.

14. A flashlight as in claim 9 further comprising means for preventing the flashlight from rolling.

15. A flashlight as in claim 9 wherein the tail is substantially tubular with a battery receiving area therein.

16. A flashlight as in claim 9 wherein a length of the neck between the illumination head and the rigid tail remains the same in both the extended and a retracted position of the sleeve.

17. A method of converting a flashlight having a repositionable illumination head into a substantially rigid configuration comprising steps of:

providing the flashlight with a longitudinally slideable rigid sleeve; and sliding the sleeve from a retracted position on a tail of the flashlight to an extended position along a flexible neck of the flashlight to thereby prevent the neck from flexing and prevent repositioning of the illumination head relative to the tail.

18. A method as in claim 17 further comprising interlocking a front of the sleeve with a portion of the illumination head.

* * * * *

UNITED STATES PATENT AND TRADEMARK OFFICE

CERTIFICATE OF CORRECTION

PATENT NO. : 5,716,121
DATED : February 10, 1998
INVENTOR(S) : Craig A. DuBois

It is certified that error appears in the above-identified patent and that said Letters Patent is hereby corrected as shown below:

Title page, item [73], Assignee: should read-- Black & Decker Inc., Newark, Delaware --.

Signed and Sealed this

Seventh Day of April, 1998

Bruce Lehman

*Attest:*

BRUCE LEHMAN

*Attesting Officer*

*Commissioner of Patents and Trademarks*